United States Patent [19]

Delamour et al.

[11] Patent Number: 4,896,787

[45] Date of Patent: Jan. 30, 1990

[54] ARTICLE WITH RESILIENT HINGES BECOMING RIGID UNDER TENSION

[75] Inventors: Dominique Delamour, Les Mesnuls; Olivier Rodi, Neauphle le Chateau, both of France

[73] Assignee: Genus International, France; a part interest

[21] Appl. No.: 232,454

[22] Filed: Aug. 15, 1988

[30] Foreign Application Priority Data

Aug. 14, 1987 [FR] France ..... 87 11592
Nov. 13, 1987 [FR] France ..... 87 15706

[51] Int. Cl.[4] ..... B65D 6/18
[52] U.S. Cl. ..... 220/339; 220/6
[58] Field of Search ..... 220/6, 7, 62, 339

[56] References Cited

U.S. PATENT DOCUMENTS

| | | | |
|---|---|---|---|
| 2,144,318 | 1/1939 | Kryder . | |
| 4,005,795 | 2/1977 | Mikkelsen | 220/62 |
| 4,010,865 | 3/1977 | Wilgus | 220/62 |
| 4,170,313 | 10/1979 | Caves | 220/7 |
| 4,202,457 | 5/1980 | Tansi | 220/7 |
| 4,235,346 | 11/1980 | Liggett | 220/62 |
| 4,505,404 | 3/1985 | Perchak | 22-/339 |
| 4,722,473 | 2/1988 | Sandrini | 220/7 |

FOREIGN PATENT DOCUMENTS

| | | | |
|---|---|---|---|
| 2329313 | 12/1974 | Fed. Rep. of Germany . | |
| 2750849 | 5/1979 | Fed. Rep. of Germany . | |
| 2939265 | 4/1981 | Fed. Rep. of Germany . | |
| 2259019 | 8/1975 | France | 220/7 |
| 844723 | 8/1964 | United Kingdom . | |
| 1298673 | 12/1972 | United Kingdom | 220/7 |

OTHER PUBLICATIONS

Modern Plastics International, vol. 1, No. 8, Aug. 1971, pp. 78–79; "En-Route to the All-Plastic Refrigerator", *p. 78, lines 1–23*.

*Primary Examiner*—George E. Lowrance
*Attorney, Agent, or Firm*—Larson and Taylor

[57] ABSTRACT

An article is provided with resilient hinges becoming rigid under tension, comprising at least two rigid elements (2,3), means for hinging these two elements together and means for locking these elements with respect to each other in a folded up position. The hinge means (1) comprise a part with resilient properties (4) connecting these two elements together, said hinge means being adapted so as to cause the part with resilient properties to occupy a relaxed position when the two elements are not locked with respect to each other and a tensioned position when the two elements are locked with respect to each other. Good rigidity of the hinge joining the two elements together is thus provided when the locking means are activated.

16 Claims, 8 Drawing Sheets

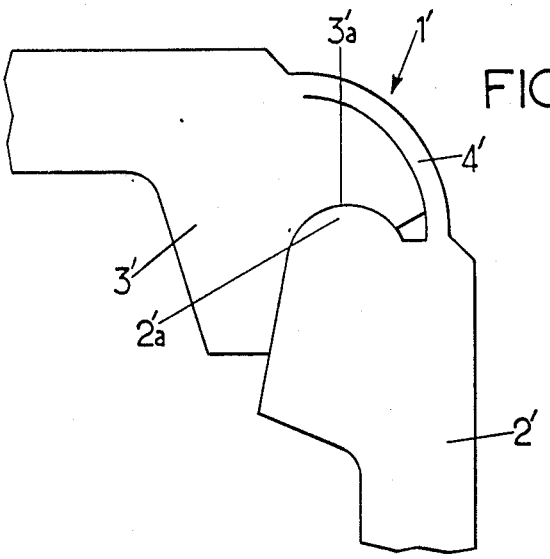
FIG.12.
FIG.13.
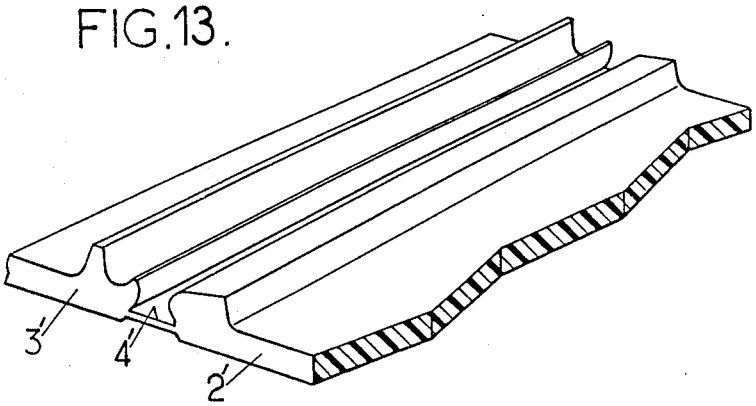

ARTICLE WITH RESILIENT HINGES BECOMING RIGID UNDER TENSION

BACKGROUND OF THE INVENTION

The present invention relates to pieces or articles of the type comprising at least two rigid elements, each extending substantially in the same plane, means for hinging these two elements together for pivoting between a first position in which these two elements form a first angle therebetween (which may in particular mean that the two elements are substantially in the same plane) and a second position in abutment one against the other where these two elements form a second angle therebetween and means for locking these two elements with respect to each other in the second position.

It is particularly suitable, although not exclusively, for electronic exquipment boxes or cases such as microcomputer cases, HI-FI equipment cases, photographic or camera cases.

Other fields of application, also particularly interesting, are the fields of folding furniture articles and of all articles comprising an opening portion and a fixed portion, the opening portion being hinged for closing sealingly on the fixed portion (such as windows, refrigerator doors, vehicle glove boxes, etc. . . . ).

Articles of the above defined type comprising elements mounted for pivoting with respect to each other are already known.

For example, there exist filing boxes or cases formed of sheets of semi flexible and semi rigid plastic material joined together. The hinge of the opening portion with the cardboard storage box portion is typically formed by a thinned part of the plastic sheet separating the portions, on the whole length of the hinge between said portions. A fixing tongue retains the opening portion on the case in a folded position when it is closed.

Such a device has several drawbacks. The rigidity of the case is not good, which causes its deformation when the case is loaded too much. The hinge is fragile and risks breaking in the long run.

Finally, the use of such a device as a case is limited. In particular, it is not possible to open alternatively such a case on all its faces or to fix items such as electronic equipment on said faces.

At the present time, the cases containing electronic equipment are moreover designed quite differently. They are manufactured from removable non hinged plates, fixed together during assembly by screwing or any other equivalent means.

Such a design gives sufficient rigidity and solidity to the case but requires the management of a considerable stock of spare parts corresponding to each of the faces and a rather long manufacturing assembly time. Also, with this design, the risk of loosing a fixing screw in the case during assembly exists.

In the furniture field, the known hinges for furniture do not allow the component hinged elements to be placed flat with respect to each other, except for light furniture (folding bridge table for example).

Stronger folding furniture (such as folding chairs) require large storage or transport spaces and therefore involve appreciable costs.

SUMMARY OF THE INVENTION

It is an object of the invention to provide an improved article of the above defined type. It is a more particular object to provide an improved article consisting of a one piece case made from a composite material, for example for electronic equipment. It is another object of the invention to provide resistant folding articles allowing easy storage and optimized transport.

Another object of the invention is to provide articles easy to assemble and to manufacture. It is another object of the present invention to provide a hinge which eliminates the clearance problem between different adjacent elements connected together, except for the unavoidable manufacturing tolerances. A very precise relative positioning of the elements with respect to each other is possible, with excellent repeatability. In other words, after each operation of the hinge, the elements come back precisely and systematically to the same place, in the locked position.

According to the invention there is provided a hinged article comprising at least two substantially planar rigid elements, hinging means rotably connecting said two rigid elements, and comprising a resilient part connected to said rigid elements and having a small thickness as compared with its length measured between connections of said part to said rigid elements, said part being arranged to take up a loosened position when the two rigid elements form a first angle therebetween and a stiffened position where said part is tensioned along said length when the two rigid elements form a second angle therebetween, and locking means for locking said two rigid elements with respect to each other in said second position, whereby, when the two rigid elements are locked in said second position, the tensioned resilient part provides good rigidity for said hinging means.

The invention also provides advantageous embodiments wherein:

the resilient part or part with resilient properties is a piece fixed rigidly, for example removably, to the two elements, the part with resilient properties and the two rigid elements are integral with one another, made from the same material, the piece forming the two rigid elements and the part with resilient properties are made from a thermoplastic elastomer material whose resilient properties can be varied and which is of the type known under the trademark HYTREL, the part with resilient properties is a resilient material piece, e.g. made from rubber, the part with resilient properties is a metal piece, e.g. made from a corrugated tongue forming a spring, the hinge means are adapted so as to progressively tension the resilient part up to an extreme tension point, then to relax this tension so as to assist the arrival of the two rigid elements in the locked position one against the other, the part with resilient properties is relaxes when the two elements are substantially flat in the same plane and tensioned when the two elements form an angle less than 150° with each other, the locking means comprise at least one intermediate locking notch and the hinge means are adapted so as to cause the resilient part to occupy an intermediate tensioned position when the two elements adopt an intermediate position between the first position and the second position, corresponding to intermediate locking, the hinge means comprise a projection, e.g. elongate, forming a ball joint and fast with one of the elements and a groove adapted for cooperating with said projection formed in the other element. The part with resilient properties may then be adapted so as to bear on said elongate projection during tensioning thereof or to be inserted in a recess formed in said projecting part so as to permit the part with resilient properties to pass an extreme tension point and then relax in order to assist the drawing together of the two rigid elements before locking, the article comprises at least five elements substantially in the form of rectangular plates comprising a central element and four peripheral elements joined to each of the sides of said central element by the hinge means so that in the folded up position of the peripheral elements with respect to the central element, the assembly forms a substantially parallelepipedic case, the elements are made from a rigid plastic material (thermoplastic or heat hardenable polymer) for example reinforced with glass fibers or synthetic fibers, the plastic material is acrylonitrile butadiene and styrene terpolymer, the part or parts with resilient properties are made from elastomer (natural or synthetic rubber) for example from butadiene and styrene based synthetic rubber GRS. The rubber may also comprise silicon or any other element as is known in the prior art, the means for locking one element on the other are formed by clips, lockable and unlockable by simple pressure.

The invention also provides a case made from a plastic material for electronic circuits comprising the same base and four lateral elements and means for fixing each lateral element to a respective side of the base element, characterized in that said fixing means comprise means for hinging each lateral element with said base element between a flat position in which all the elements are substantially in the same plane and a folded up position, with each lateral element in abutment against the base element so as to form the case, in that they comprise means for locking each lateral element with respect to the base element in these respective folded up abutment positions so as to maintain the case in the closed position, and in that said hinge means are formed by resilient material pieces connecting each of the lateral elements respectively to one side of the base element, said hinge means being adapted for tensioning said pieces between a rest position of said pieces when the lateral elements are flat with the base element and a tensioned position of said pieces when the lateral elements are locked with respect to the base element in the closed position of the case, so that the tensioned resilient pieces provide good rigidity of the hinges between each of the four lateral elements and the base element when the locking means are activated.

In an advantageous embodiment, the lateral elements and the base element are made from thermoplastic polymer of moulded ABS type and the resilient material pieces are made from synthetic elastomer, of the synthetic butadiene and styrene based rubber type moulded in spaces previously formed in the plastic material elements with which said resilient material pieces are welded together at the time of said moulding.

BRIEF DESCRIPTION OF THE DRAWINGS

The invention will be better understood from the following description of particular embodiments, given by way of non limitative example. The description refers to the accompanying drawings in which:

FIG. 12 is a partial side view of an article made in accordance with the particular embodiment of the invention in which the part with resilient properties and the two rigid elements are formed by the same piece, in the folded up position, FIG. 13 is a partial perspective view of the hinge of FIG. 12 in the flat position.

DESCRIPTION OF PREFERRED EMBODIMENTS

Figure 1:
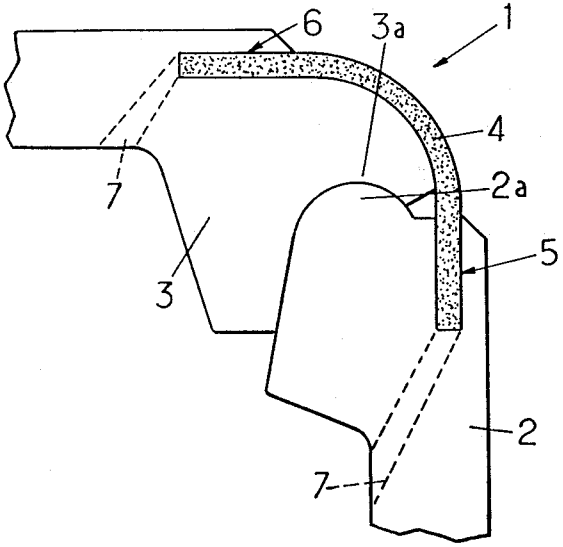
FIG. 1 is a partial side view of an article in accordance with the invention, whose part with resilient properties is a resilient material piece in the folded up position.

FIG. 1 shows hinge means 1 of an article comprising two elements, a "male" element 2 (comprising a projecting portion 2*a*) and a "female" element 3 (comprising a hollow portion 3*a*) in the folded up position and in abutment against each other, elements 2 and 3 forming an angle therebetween, for example of 90°.

Figure 3:
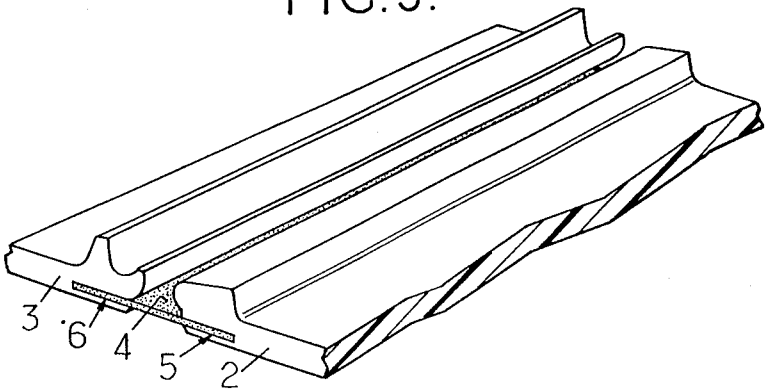
FIG. 3 is a partial perspective view of the hinge of FIG. 1 in the flat position.

FIG. 3 shows the same elements 2 and 3 in the flat position. These two elements are rigid, each extending substantially in the same plane. The hinge means 1 further comprise a piece 4 made from a resilient material fixed rigidly at 5 and 6 to the two elements which it connects together.

The resilient piece 4 has a small thickness as compared with its length measured between connections 5 and 6 of said piece 4 to said rigid elements. It means that the length is at least 5 times greater than the thickness and for example between 10 times and 30 times greater.

When the two elements are substantially in the same plane, the resilient material piece 4 occupies a relaxed position (FIG. 3). When the two elements are in the folded up position, and when they are locked with respect to each other by locking means (not shown in FIGS. 1 and 3), piece 4 occupies a tensioned position so that it provides good rigidity of the means 1 hinging the two elements 2 and 3 together. The resilient material piece 4 is flexible and has a certain extensibility. In the rest position, the hardness of the resilient piece may for example be about 90 shores and pass to 100 shores with a 3% extension when it is tensioned (e.g. with about 30 g of pressure). But, depending on the application, the three parameters of hardness, extension and value of the pressure exerted may be varied as desired.

In FIGS. 1 and 3 a welded type connection has been shown between elements 2 and 3 and piece 4. They are then all three made from a plastic material, e.g. ABS polymer for elements 2 and 3 and elastomer containing butadiene and styrene for piece 4. The latter is moulded in elements 2 and 3 before final solidification thereof. In FIG. 1, channels 7 have been shown with broken lines having served for flowing the elastomer.

Figure 2:
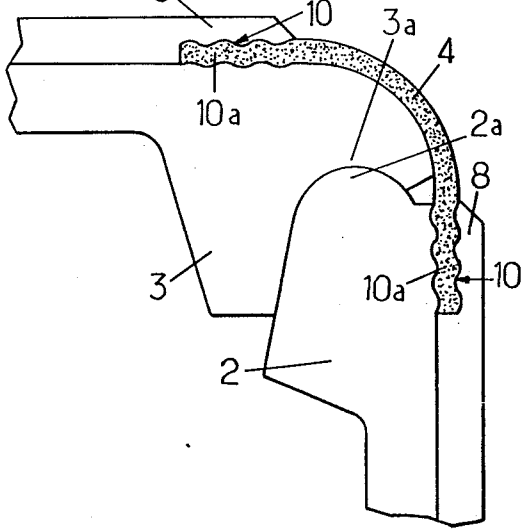
FIG. 2 is a side view of a variant of FIG. 1, with a removable resilient material piece.

FIG. 2 shows a variant in which pieces 2 and 3 are made from a plastic material or another material (aluminium, steel, etc. . . . ). In this case, the elastomer piece 4 can no longer be fixed by welding as is the case of FIG. 1 with elements 2 and 3. Pieces 8 and 9 having indentations 10 in which the ends 10*a* of piece 4 are inserted, said indentations being for example corrugated so as to promote fixing, are provided and secured to elements 2 and 3 by means known per se (not shown).

Piece 4 may also be fixed to elements 2 and 3 by bonding or any other fixing means known to a man skilled in the art.

Figure 2A:
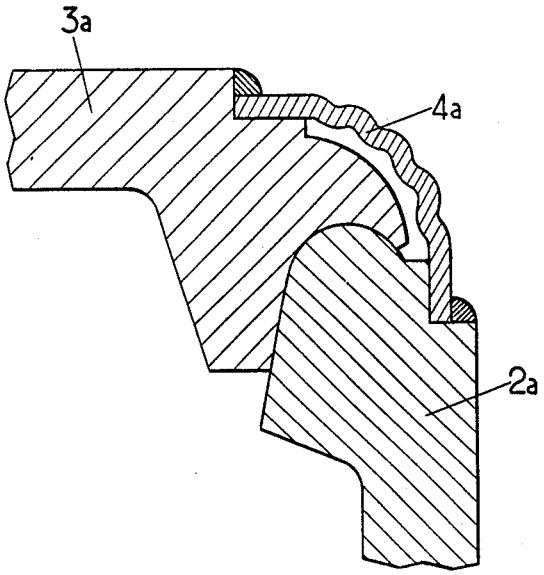
FIG. 2*a* is a partial side view of a hinge of the invention comprising a metal resilient piece in the form of a corrugated tongue.

FIG. 2*a* shows a variant in which piece 4*a* is formed by a corrugated metal tongue. The tongue may then be fixed to pieces 2*a* and 3*a*, if they are also made from metal, by welding or any other known means. The use of a piece with resilient properties which is made from metal means that the hinge may withstand temperatures and difficult conditions without being damaged. This arrangement has important advantages with particularly interesting applications in the automobile industry.

Figure 4:
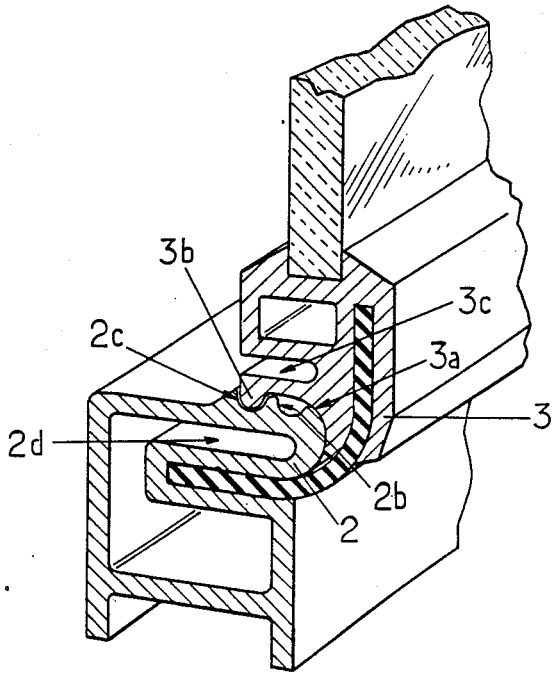
FIG. 4 is a partial perspective view of a variant of the invention with two locking positions applied to a window.

FIG. 4 shows a variant of the hinge of the invention in which two locking positions are possible. Element 3 comprises a tongue 3*b* adapted for cooperating with a first indentation 2*b* or a second indentation 2*c* of the male element 2. In FIG. 4 the application of the hinge to a window has been shown whose element 2 forms part of the fixed portion and element 3 part of the opening portion. Spaces 2*d* and 3*c* are formed in the body of the elements so as to provide a certain resilience and flexibility of the elements with respect to each other.

Figure 5:
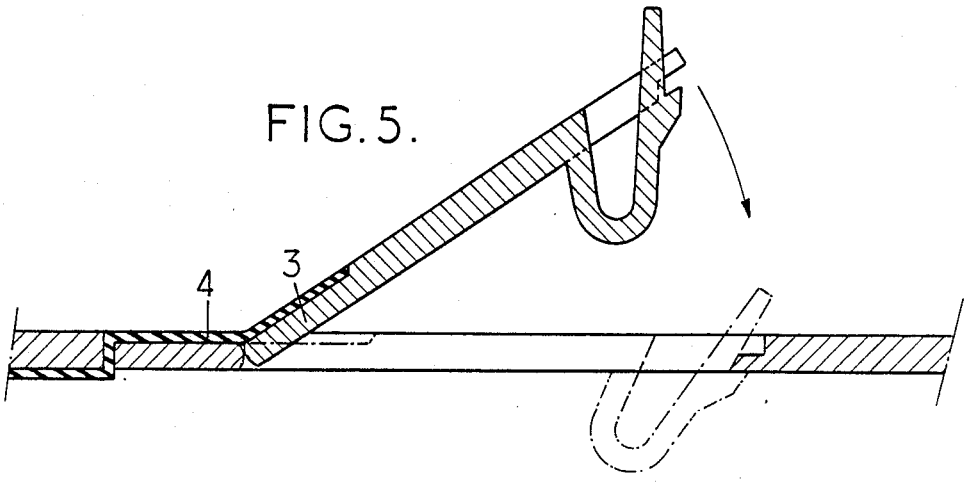
FIG. 5 is a sectional view of another hinge of the invention, in which the part with resilient properties is acted on by a force when the two rigid elements are in the same plane.

FIG. 5 shows a variant of the invention in which the rest position of the resilient piece is provided when elements 2 and 3 from an angle with respect to each other, the tensioned position being obtained when the elements are flat in the same plane.

Figure 6:
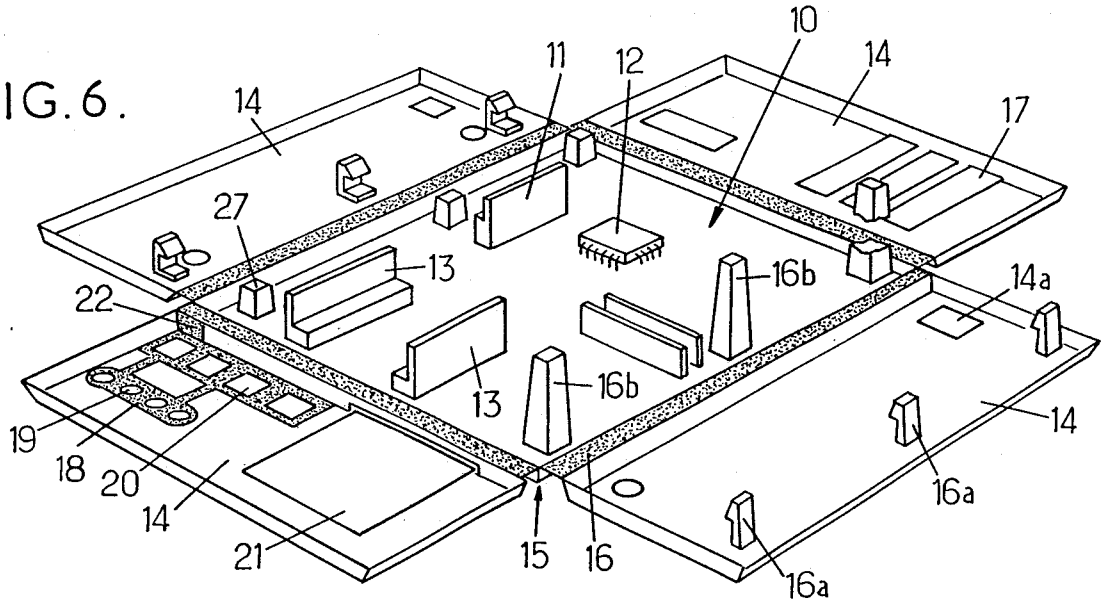
FIG. 6 is a partial schematic and perspective view of a case for electronic components, according to an advantageous embodiment of the invention.

FIG. 6 shows a case for electronic circuits in accordance with the invention. This case has a base element 10 in the form of a plate on which electronic circuits are permanently or removably fixed. An electronic card 11, a chip carrier 12, vertical supports 13, etc. . . . have been shown by way of indication in FIG. 6. The case also comprises lateral elements 14 connected by the hinge means of the invention, shown schematically at 15, to the base element 10 on each of the sides of said base element. Elements 14 are able to fold up about hinge means 15 so as to bear on each other and be fixed by locking means 16*a*, 16*b* in the folded up position with respect to the base element and thus form the substantially parallelepipedic shaped case. All the locking means have not been shown so as not to overload the figure.

Elements 14 comprise input-output plugs 14*a* for communicating the inside of the case with external connection cables. They also advantageously comprise either their own electronic circuits 17, or an interface keyboard 18 comprising push buttons 19 or buttons operating through resilient contacts 20. In these lateral elements may also be incorporated a screen 21 or any other device known per se to be found in or on electronic cases, whether they are cases for micro-computers, HI-FI equipment etc. The hinge means 15 comprise a resilient material piece 16 fixed rigidly to the lateral elements on the one hand and to the base on the other.

These resilient pieces, connected, to the rigid elements, on each of their extremities, have a small thickness as compared with their length measured between connections of said pieces on their corresponding rigid elements (i.e. for example ten or twenty times smaller).

A particularly interesting fixing method is that described above, the elements being made from a thermoplastic material of ABS type and the resilient material piece being moulded on the base piece formed by the assembly of the five elements which can be seen in FIG. 6. The same aparatus will be advantageously used for injecting first of all the heat hardenable plastic forming the rigid elements and secondly the elastomer material forming piece 16 of hinge 15. During flowing of the elastomer, it may advantageously penetrate, through paths 22 previously prepared in the initial mould, into spaces formed in the different elements for forming a portion of the keyboard 18 actuated by pressure of one of the lateral elements.

Figure 7:
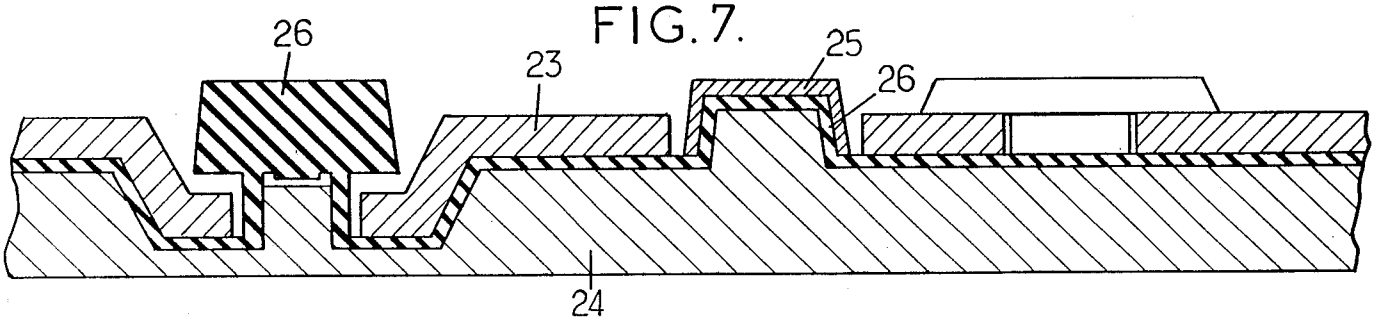
FIG. 7 is a partial sectional view of one face with integrated keyboard of the case of FIG. 6.

FIG. 7 shows different control button devices, parts 23, 24, 25 being made from hard material and the parts shown at 26 being made from a softer material: elastomer. The construction of this type of keyboard being known per se it will not be described further.

Figure 8:
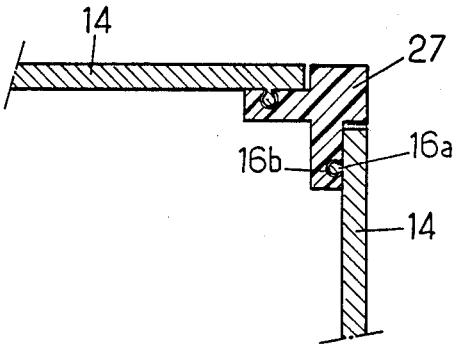
FIG. 8 is a sectional view of a case corner of a type applicable to the case of FIG. 6, with the faces folded up.
Figure 9:
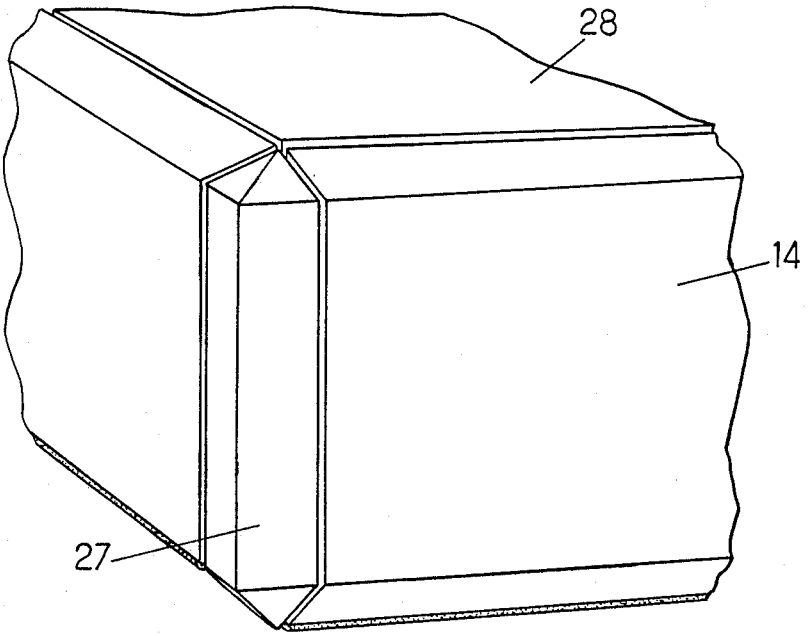
FIG. 9 is a schematic perspective view of the corner of FIG. 8.

In FIGS. 8 and 9 corner pieces 27 have been shown secured to the base plate 10 and on which the lateral elements 14 are clipped or locked. In FIG. 8, the locking elements 16*c* and 16*d* are shown schematically and may for example be formed by small balls locked in holes whose inlet diameter is slightly less.

FIG. 9 gives in perspective and partially an idea of the external appearance of the case when it is in the folded up position.

Although it has not been shown in FIG. 6, it is possible and even advisable to add an additional element connected to one of the lateral elements by the side opposite that connected to base 10 of said lateral element, so as to be able to form the lid 28 of the case when all the lateral elements have been folded up into the closed position. This lid 28 rests for example on a portion of the upper part of the columns 27 of base 10.

Figure 10:
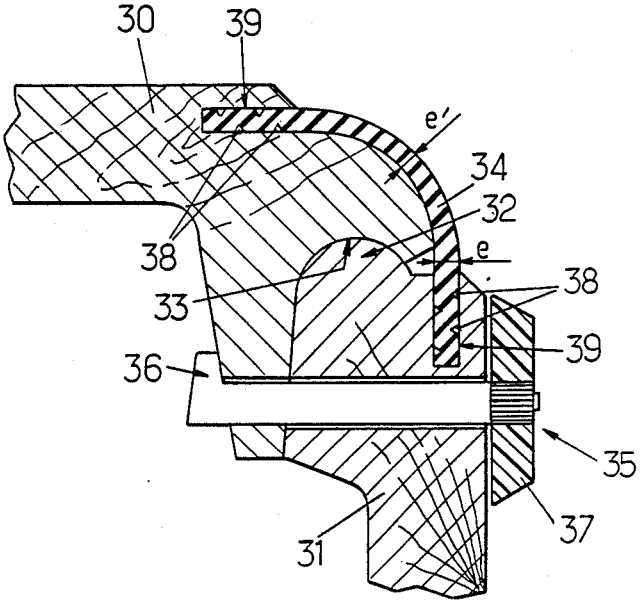
FIG. 10 is a side sectional view of a hinge of the invention, for example applied to a folding piece of furniture such as a table.
Figure 11:
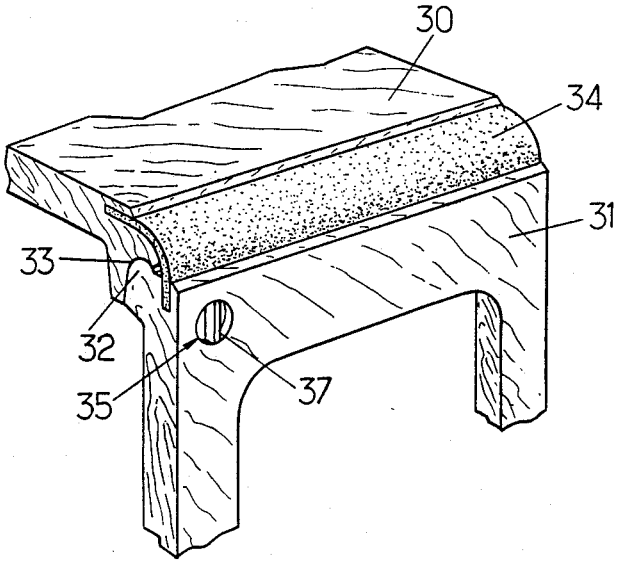
FIG. 11 is a partial perspective view of the hinge portion of a table of the invention.

In FIGS. 10 and 11, a piece of furniture has been shown partially using the same hinging principle as that of the above described case.

FIG. 11 shows in perspective and in a partial view two elements which may form a table or stool.

It is a question of an upper element 30 on which objects may be laid and an element serving as foot 31.

These elements may be formed of all materials, plastic, wood, etc.

The hinge means are formed by an elongate projection forming a ball joint 32 and a groove 33 adapted for cooperating with the projection, one belonging to element 31 and the other to element 30. The resilient material piece 34 provides the connection and fixing of two elements with respect to each other. In the folded up position, such as shown in FIGS. 10 and 11, the tensioning of this piece ensures good rigidity of the assembly.

Locking means 35, comprising for example means 36 for progressive tensioning of piece 34, for example by rotation of a wheel 37, are shown in the figures. Other tensioning and locking means may be used and are within the scope of a man skilled in the art.

In FIG. 10, it can be seen that, because of the tensioning of the resilient piece 34, the thickness e of this piece at the fixing level to one of the elements is greater than the thickness e' which may be measured in the middle part of the piece at the level of the ball joint 32 of element 31. Means 38, formed for example by studs or any other means preventing piece 34 from sliding with respect to elements 30 and 31, are provided in the two longitudinal indentations 39 of elements 30 and 31 in which piece 34 is inserted for joining said elements together.

FIGS. 12 and 13 shows one particularly advantageous embodiment of the invention in which the part with resilient properties and the two rigid elements connected together by said part are formed by one and the same piece.

There in fact exist materials whose hardness and extensibility vary depending on the thickness chosen and/or on the specific treatments applied to the part which it is desired to make more or less resilient.

In particular, the single piece used as hinge in one embodiment of the present invention is formed from thermoplastic elastomer of a type known under the trademark HYTREL registered by Du Pont de Nemours for its technical thermoplastic elastomers. This type of thermoplastic elastomer groups together a large number of characteristics desired in rubbers and high performance flexible plastics. It has great tenacity and offers exceptional resilience, high flow resistance, resistance to shocks and fatigue as well as to repeated flexions. Excellent flexibility at low temperatures and good conservation of these properties at high temperatures are also among the important qualities of the thermoplastic elastomers of this type. It further resists deterioration due to numerous industrial chemical agents, oils and solvents.

The different methods of using the thermoplastics, particularly by injection moulding, extrusion, extrusion-blowing, rotary moulding and flowing in the molten state, make it possible to readily manufacture high performance pieces with the desired forms.

Depending on the transformation method and the type of polymer used, temperatures between 170° C. and 250° C., for example about 200° C., are used.

With elastomer thermoplastics of the HYTREL type, a hinge can thus be formed of the same type as that of the article of the invention in a single piece, thus replacing multiple plastic, wood or metal pieces joined together by a rubber type resilient material piece.

The article shown partially in FIGS. 12 and 13 is formed essentially of two elements or portions: a "male" portion 2' (comprising a projecting part 2'a) and a "female" portion 3' (comprising a hollow portion 3'a). FIG. 12 shows in the folded up position and in abutment one against the other, the elements or portions 2' and 3' forming an angle therebetween, for example of 90°.

FIG. 13 shows the same portions 2' and 3' in the flat position. The two elements are rigid and each extends substantially in the same plane. The hinge means 1' further comprises a resilient portion 4' fast with portions 2' and 3' which it joins together. Portions 2' 3' and 4' forming one and the same piece but having, for portions 2' and 3', considerable rigidity and hardness whereas portion 4' is resilient and extensible.

When the two portions 2' and 3' are substantially in the same plane, the resilient portion 4' occupies the relaxed position (FIG. 13). When the two portions 2' and 3'' are in the folded up position, and when they are locked together by locking means (not shown in FIGS. 12 and 13) portion 4' occupies a tensioned position so that it provides good rigidity of the means 1' hinging the two portions 2' and 3' together. The resilient portion 4' is flexible and has a certain extensibility. In the rest position, the hardness of the resilient portion may for example be about 80 shores and pass to 100 shores with a 3% extension when it is tensioned (e.g. with a pressure of about 30 g). But, as has been seen and depending on the application, the three parameters of hardness, extension and value of the pressure exerted may be varied as desired by adjusting the composition and the thickness of the thermoplastic elastomer, of HYTREL type, used.

Figure 14:
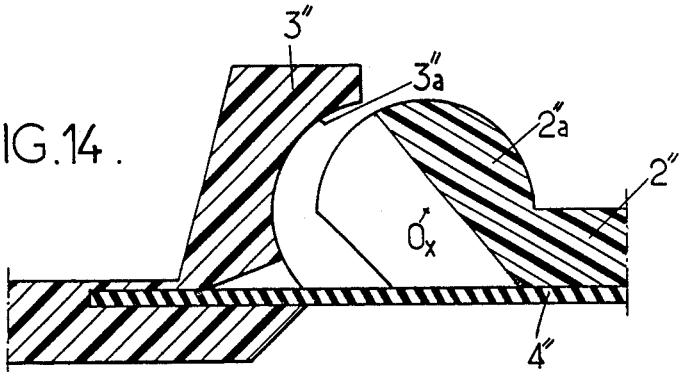
FIG. 14 is a partial sectional view of a hinge according to another advantageous embodiment of the invention, adapted for causing the resilient piece to pass through an intermediate maximum tension before locking, in the flat position.
Figure 15:
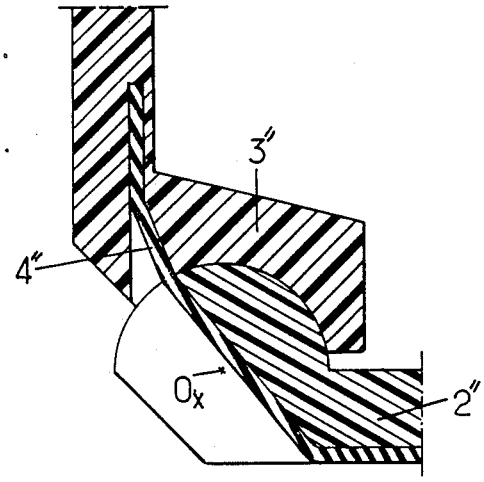
FIG. 15 is a partial sectional view of the hinge of FIG. 14 in the folded up position.

FIGS. 14 and 15 show another advantageous embodiment in which the part with resilient properties, e.g. a rubber piece 4'' is adapted so as to occupy a position extending beyond the axis of rotation Ox of the hinge, in the folded up position (FIG. 15). Thus, when element 3'' rotates about the ball joint 2''a of element 2'', the resilient piece passes through a maximum tension, which decreases once the plane of said piece 4'' has passed beyond the axis Ox, which assists in bringing it into the position for locking the two elements 3'' and 2'' with respect to each other.

As is evident and as it is clear from the foregoing, the invention is in no wise limited to those of its modes of application which have been more especially considered; it embraces, on the contrary, all variants thereof, particularly those in which:

the elements extending substantially in the same plane comprise protruding parts fixed or integral with said elements, for example substantially perpendicularly to the plane in varied number, volume and dimensions, the resilient connecting piece between two same elements is split up, formed by several portions spaced apart from each other, the resilient piece is not fixed to the same element over the whole length of the element but only over a part thereof, the elements joined together are made from different materials, The elements may, because of the intermediate locking means, adopt several intermediate positions corresponding to different tensions of the resilient material piece between the relaxed, rest, or loosened position and a tensioned or endmost position, which is not necessarily the position in which the tension is the highest of said different tensions.

We claim:

1. Article comprising at least two rigid generally planar elements, hinging means for hinging these two elements together for pivoting between a first position in which these two elements form a first angle therebetween and a second position in abutment one against the other in which these two elements form a second angle therebetween and means for locking these two elements with respect to each other in the second position, said hinge means comprising a resilient part having resilient properties connecting said elements together, said hinge means being shaped such that said resilient part occupies a relaxed position when the two elements occupy their first position and a tensioned position when the two elements are locked with respect to each other in their second position, the resilient part, under tension in the second position, comprising a means for providing substantial rigidity to the hinge between the two elements when the locking means is locked.

2. Article according to claim 1, wherein the resilient part is a piece different from the two rigid elements and fixed removably to said elements.

3. Article according to claim 1, wherein the rigid elements are made from a rigid plastic material and the resilient part is made from an elastomer of the synthetic rubber type.

4. Article according to claim 1, wherein the resilient part and the two rigid elements are integral with one another, made from the same material.

5. Article according to claim 4, wherein the two rigid elements and the resilient part are made from a thermoplastic elastomer material whose resilient properties can be varied and which is of the type known under the trademark HYTREL.

6. Article according to claim 1, wherein the resilient part is formed of a resilient material piece.

7. Article according to claim 1, wherein the resilient part is a corrugated metal piece.

8. Article according to claim 1, wherein the hinging means are adapted so as to progressively tension the resilient part up to an extreme intermediate tension point, then to relax this tension so as to assist the arrival of the two rigid elements in the locked position one against the other.

9. Article according to claim 1, wherein the resilient part is relaxed when the two elements are substantially flat in the same plane and tensioned when the two elements form an angle less than 150° with each other.

10. Article according to claim 1, wherein the locking means comprise at least one intermediate locking indentation and the hinging means are adapted so as to cause the resilient part to occupy an intermediate tensioned position when the two elements adopt an intermediate position between the first position and the second position, corresponding to intermediate locking.

11. Article according to claim 1, wherein the hinging means comprise an elongated projection, forming a ball joint fast with one of the elements, and a groove adapted for cooperating with said projection, formed in the other element.

12. Article according to claim 11, wherein the resilient part is adapted so as to bear on said elongated projection during tensioning of said part with resilient properties.

13. Article according to claim 1, wherein the article comprises at least five elements substantially in the form of rectangular plates comprising a central element and four peripheral elements joined to each side of said central element by a said hinging means so that in the folded up position of the peripheral elements with respect to the central element, the assembly forms a substantially parallelepipedic case.

14. Article according to claim 1, wherein the locking means are formed by clips, lockable and unlockable by simple pressure.

15. Plastic material case for electronic circuits comprising:

at least five rigid elements substantially in the form of rectangular plates comprising a base element and four lateral elements, hinging means connecting each lateral element to a respective side of the base element for pivoting between a first position in which the base element and its respective lateral element are generally in the same plane and a second position wherein each lateral element is folded upwardly to a second position in abutment with the base element to form a second angle therebetween, means for locking the base element to each respective lateral element in the second position thereof, each said hinge means including a resilient part having resilient properties connecting the base element and the respective lateral element together, each said hinge means being shaped such that its resilient part occupies a relaxed position when the base element and the respective lateral element are in the first position and said resilient part is tensioned when the base element and the respective lateral element are locked with respect to each other in the second position, the resilient part, under tension in the second position, comprising a means for providing substantial rigidity to the hinge means between the base element and the respective lateral element when the locking means is locked.

16. Plastic material case for electronic circuits according to claim 15, wherein the lateral elements and the base element are made from thermoplastic polymer of moulded ABS type and the resilient material parts are made from synthetic elastomer, of the synthetic butadiene and styrene based rubber type moulded in spaces previously formed in the plastic material elements with which said resilient material parts are welded together at the time of said moulding.

* * * * *